US005910831A

United States Patent [19]

Videcoq et al.

[11] Patent Number: 5,910,831

[45] Date of Patent: Jun. 8, 1999

[54] SPECTACLES FRAME HOLDER

[75] Inventors: Jean-Jacques Bernard Joseph Videcoq, Pavilly; Raynald Gaston Marcel Longuet, Le Gros Theil, both of France

[73] Assignee: Briot International, Pont De L'Arche, France

[21] Appl. No.: 08/944,066

[22] Filed: Oct. 2, 1997

[30] Foreign Application Priority Data

Oct. 3, 1996 [FR] France ..... 96 12076

[51] Int. Cl.[6] ..... G02C 1/00; B25B 1/24

[52] U.S. Cl. ..... 351/158; 269/257; 269/265

[58] Field of Search ..... 351/41, 158; 248/902; 269/257, 265, 266

[56] References Cited

U.S. PATENT DOCUMENTS 5,137,263 8/1992 Savoie et al. ..... 269/266
5,363,532 11/1994 Sargent ..... 248/902
5,556,085 9/1996 Cyr ..... 269/75

FOREIGN PATENT DOCUMENTS 0 337 864 10/1989 European Pat. Off. .
2 707 108 1/1995 France .
94 12 897 8/1995 Germany .

*Primary Examiner*—Huy Mai
*Attorney, Agent, or Firm*—Wenderoth, Lind & Ponack, L.L.P.

[57] ABSTRACT

A frame holder has two jaws (1, 2) mounted so as to be slidable relative to each other in order to be movable toward or away from each other. A clamping mechanism (5) is provided for maintaining the frame (6) between the jaws in a reference plane. At least one jaw (1, 2) is provided with at least one sensor (14) which is adapted to produce a signal indicating the arrival of the jaw in a position of activation of the clamping mechanism (5) when the two jaws move toward each other. The frame holder can be used in an apparatus for analyzing rims of spectacles frames.

15 Claims, 4 Drawing Sheets

SPECTACLES FRAME HOLDER

BACKGROUND OF THE INVENTION

The present invention relates to a spectacles frame holder of the type comprising two jaws, at least one of which is slidably mounted so that the jaws are relatively movable toward or away from each other, and holding means for holding the frame between the jaws in a reference plane.

The routing or shaping of the contour of optical glass or lenses to the shape of a spectacles frame requires that the shape of the frame be precisely entered in a computer memory. This operation is carried out by using an apparatus which is capable of following and analyzing the frame rims.

To ensure precise contact, it is essential to correctly hold the frame in a stationary position during the analysis of the frame. For this purpose, a frame holder of the aforementioned type has been used. The holding means may be formed by frame-clamping clamps which are movable in a direction perpendicular to a reference plane, or by V-shaped centering elements fixed to the jaws.

As the two jaws approach each other, the operator, in some cases, must hold the frame manually until it is taken hold of by the holding means. In more sophisticated equipment, such as that described in FR-A-2 720 524, retractable support rods for the frame rims are provided to facilitate the operation and possibly render it automatic.

In any case, it is necessary to apply the frame against one of the jaws to guarantee that it is "straightened", i.e. not in an oblique position in the reference plane during the analyzing operation, and to avoid deforming the frame by the clamping thereof between the two jaws, even when the frame is easily deformable in its plane, as is the case with many frame models which have very thin metal rims.

The known frame holders do not meet this latter condition in a reliable manner, and thus an object of the present invention is to satisfy this need.

SUMMARY OF THE INVENTION

The present invention therefore provides a spectacles frame holder of the aforementioned type, which includes at least one jaw provided with at least one sensor adapted to deliver a signal when the jaw reaches a position for activating the holding device as the two jaws move toward each other.

BRIEF DESCRIPTION OF THE DRAWINGS

Embodiments of the present invention will now be described with reference to the accompanying drawings, in which.

DETAILED DESCRIPTION OF THE INVENTION

Figure 1:
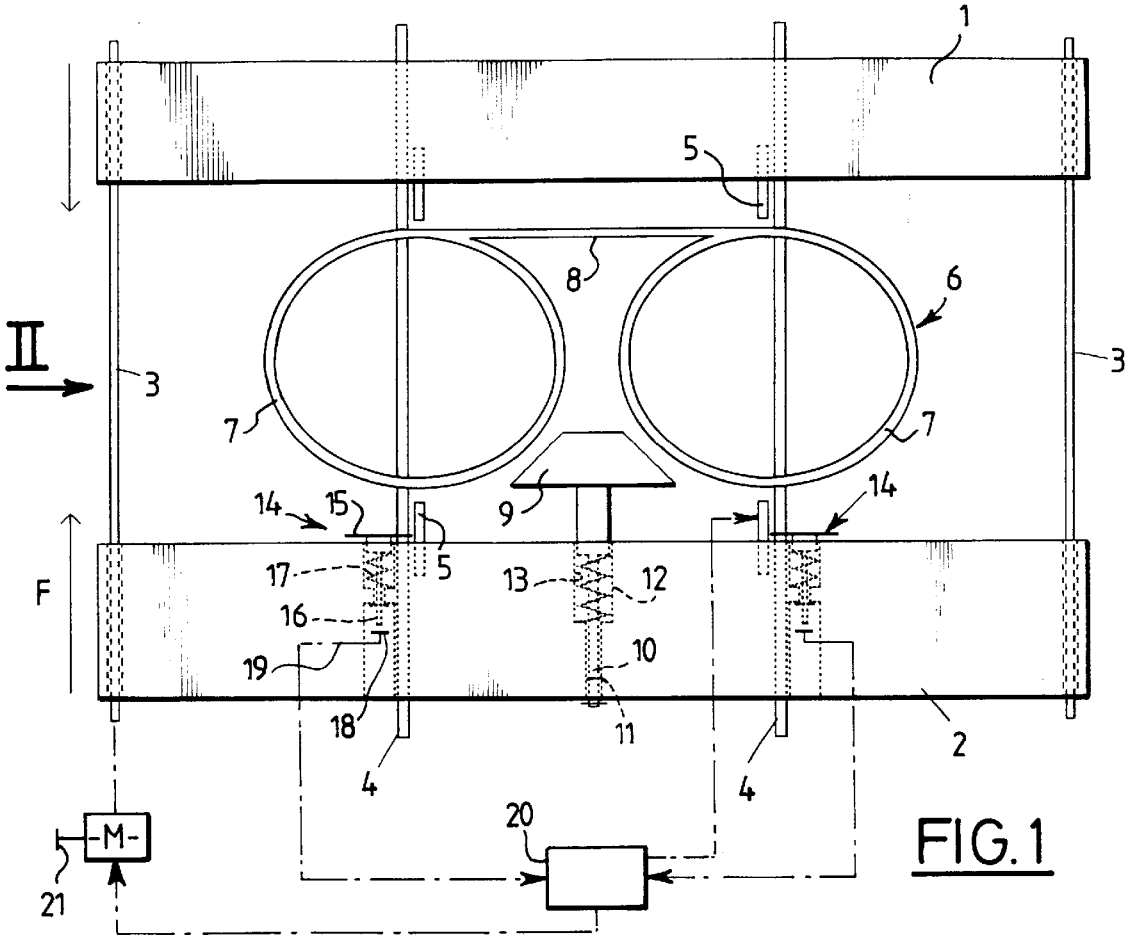
FIG. 1 is a schematic plan view of a spectacles frame holder constructed according to the invention in which a pair of jaws are separated.
Figure 2:
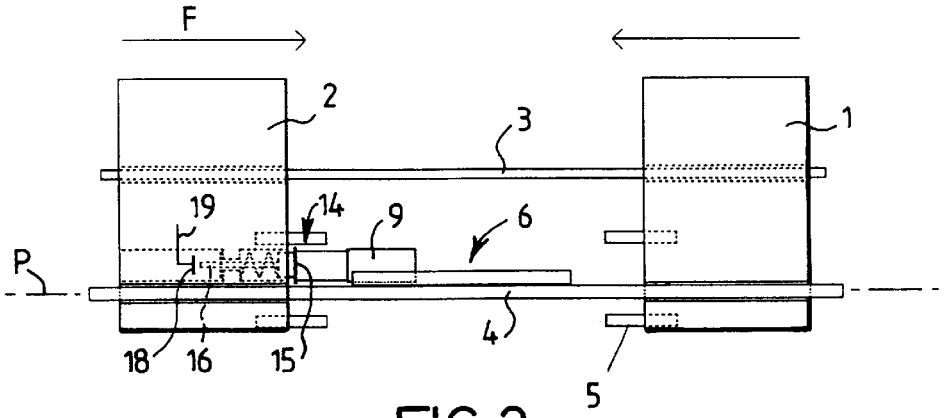
FIG. 2 is a corresponding side elevational view in the direction of arrow II of FIG. 1.

FIGS. 1 and 2 illustrate a spectacles frame holder comprising two jaws 1, 2 which are arranged so as to be generally parallel to each other. The jaws 1, 2 are capable of moving toward and away from each other by sliding along two parallel and horizontal guide rods 3 when driven by a reversible electric motor M.

The frame holder further comprises two horizontal support rods 4 which are parallel to the rods 3. The support rods 4 are located between the rods 3 and are laterally retractable while being maintained parallel to one another in accordance with the teaching of the aforementioned document FR-A-2 720 524. Each jaw includes a holding clamp 5 provided in the vicinity of an end of each rod 4 in an active position. The holding clamp 5 may be of any suitable known type whose two jaws are vertically movable.

In the active position, the rods 4 are adapted to support a spectacles frame 6 which comprises two rims 7 interconnected by a bridge 8. The jaw 1 is adjacent to the bridge 8 and is termed an upper jaw, and the other jaw 2 is a lower jaw.

Lower jaw 2 is provided with a nose member 9, which is located substantially in a reference plane P, defined by the rods 4 in the active position, and midway between the rods. The nose member 9 projects toward the jaw 1 and has a shape which converges in the direction toward the jaw 1. The nose member 9 is fixed to a horizontal pin 10 which is parallel to the rods 3 and 4 and is slidably guided in a bore 11 formed in the jaw 2. A weak spring 12 is disposed in a counter-bore 13 formed in the jaw 2 and surrounds the pin 10. The spring 12 biases the nose member 9 to the position illustrated in FIG. 1 which shows the nose member in a fully projected position relative to the jaw 2.

Further, a position sensor 14 is located in the vicinity of the "lower" end of each rod 4 in the active position. The sensor 14 essentially comprises a vertical plate 15 which is fixed to a horizontal contact pin 16 disposed parallel to the rods 3 and 4 and guided in the jaw 2. A spring 17, which is slightly weaker than the spring 12, surrounds the pin 16 and biasing the plate 15 to the illustrated position in which it slightly projects from the jaw 2. The rear end of the pin 16 is in an opposing or facing relation to an electric switch 18 that is connected by wiring 19 to an electronic control unit 20.

The operation of the spectacles frame holder will now be described.

Initially (see FIGS. 1 and 2), the jaws 1 and 2 are sufficiently spread apart to allow the frame 6 to be placed on the rods 4. In the active position, the frame does not contact the nose member 9 and is completely outside of the four clamps 5. Also, each rod 4 is approximately in alignment with the middle of the associated rim 7.

By actuating a manual switch 21, the jaws 1, 2 are driven towards each other in the direction of arrows F in FIGS. 1 and 2.

Figure 3:
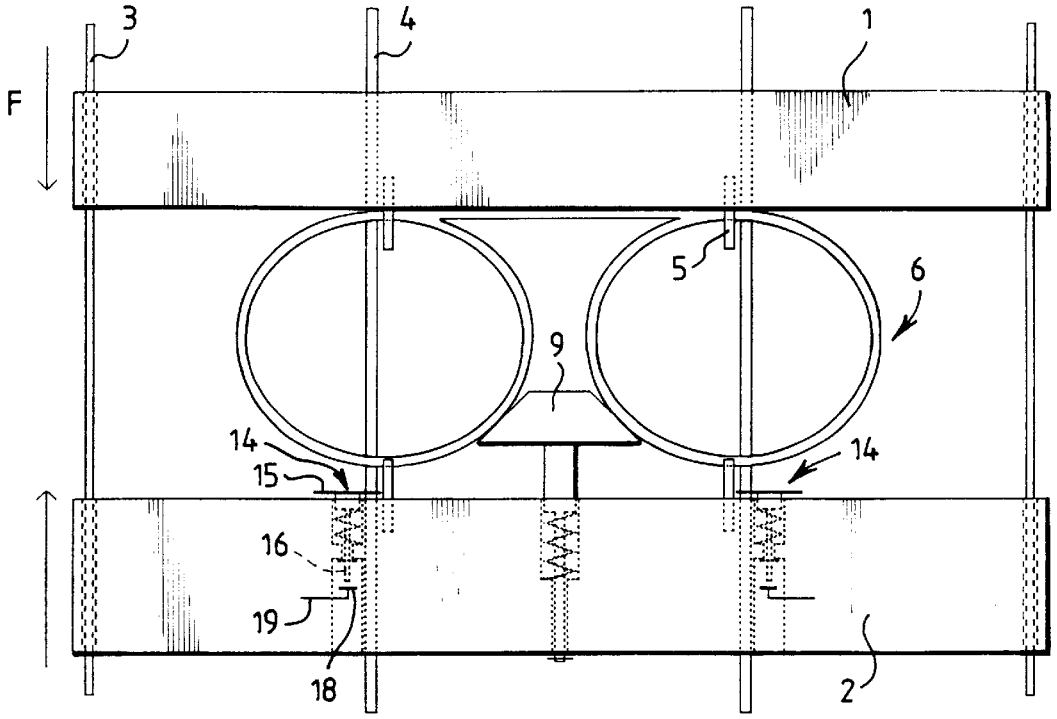
FIGS. 3 and 4 respectively correspond to FIGS. 1 and 2 but show the jaws in an intermediate position.
Figure 4:
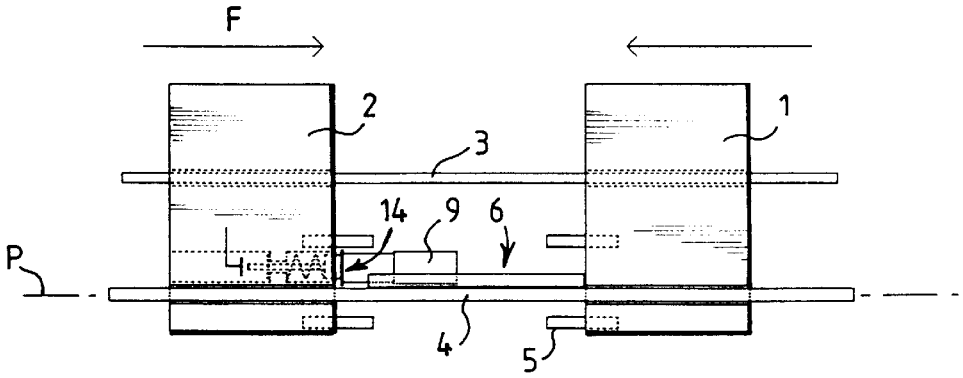

In the course of the movement of the jaws, the nose member 9 initially comes into contact with the rims 7, and then urges the frame toward the jaw 1 until the bridge 8, or the two rims, depending on the frame model, comes into contact with the jaw 1 (FIGS. 3 and 4).

Figure 5:
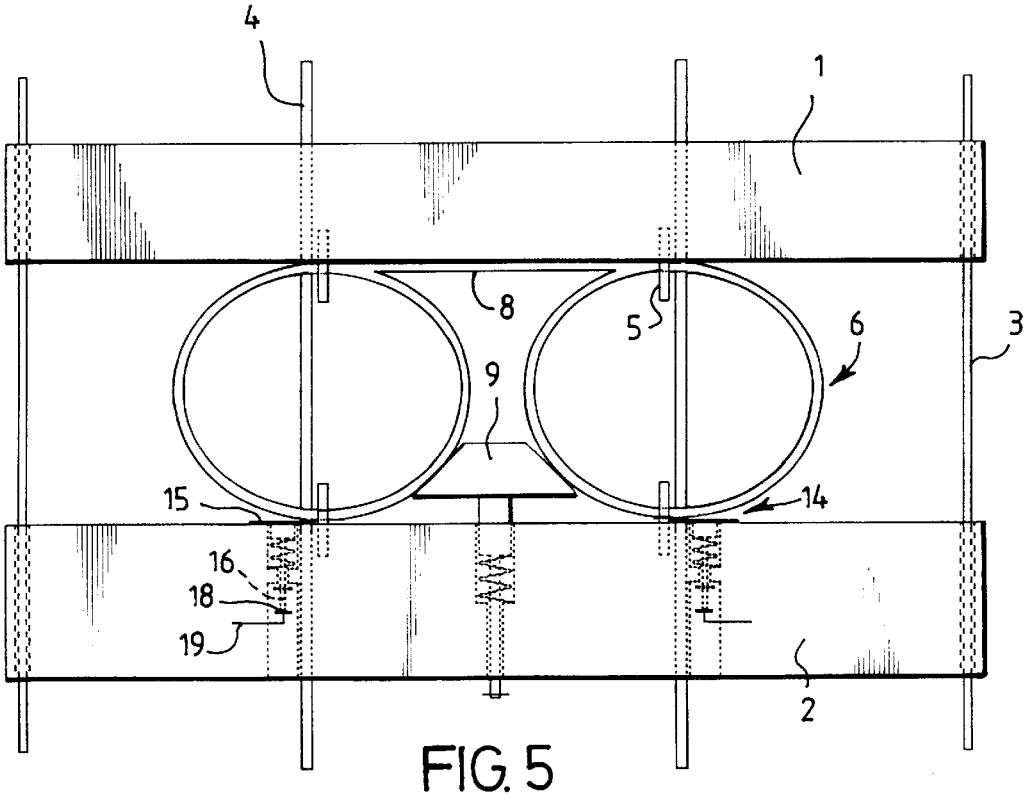
FIGS. 5 and 6 respectively correspond to FIGS. 1 and 2 but show the jaws in a final position.
Figure 6:
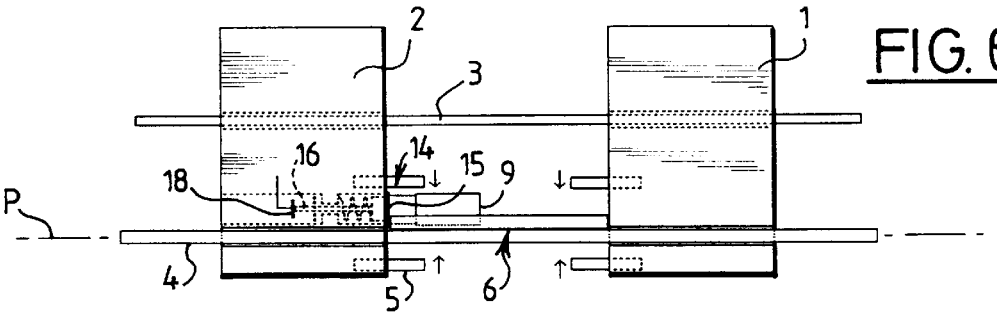

The frame is then straightened, and as the jaws continue to move toward each other, the spring 12 is compressed and this produces practically no deformation of the frame, and then the rims 7 come into contact with the respective plates 15. Then, just before the jaw 2 comes into contact with the rims 7, the depression of the two sensors causes the pins 16 to come into contact with the switches 18. The resulting electric signal causes the control unit 20 to stop the motor M (FIGS. 5 and 6).

Figure 7:
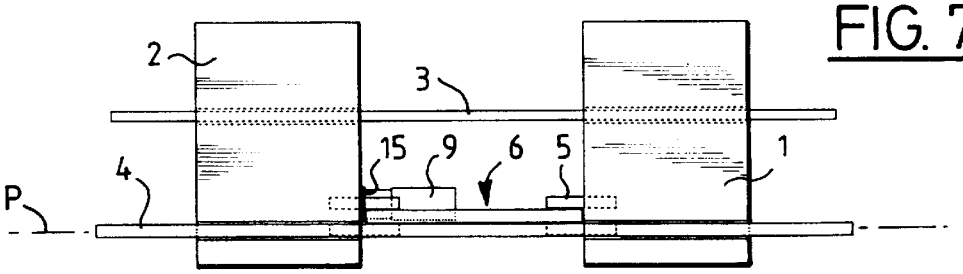
FIG. 7 is a view similar to FIG. 6 after the holding clamps have been closed.

In this way, it is ensured that the frame 6 is both straightened and non-deformed. The unit 20 then actuates the four clamps 5 which close and firmly hold the frame in position for the analysis thereof (FIG. 7).

In a variation of the above-described embodiment, in order to guarantee the complete absence of deformation of the frame by the jaws, it may be arranged that the signals produced by the depression of the sensors 14 cause, through the unit 20 and the motor M, a slight separation of the jaws until the signal ceases to be delivered by the sensors.

In another variation, the clamps 5 may be actuated manually after the jaws have stopped moving.

Figure 8:
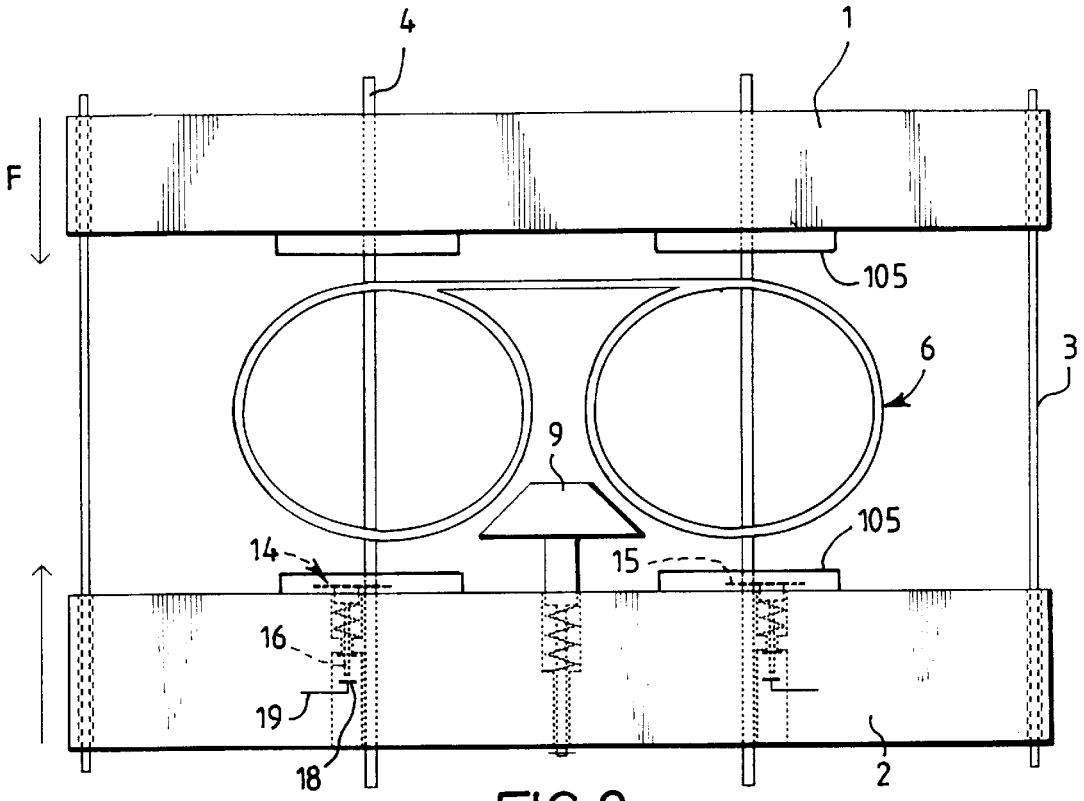
FIGS. 8 and 9 are similar to FIGS. 1 and 2 respectively, but illustrate a variation of the spectacles frame holder.
Figure 9:
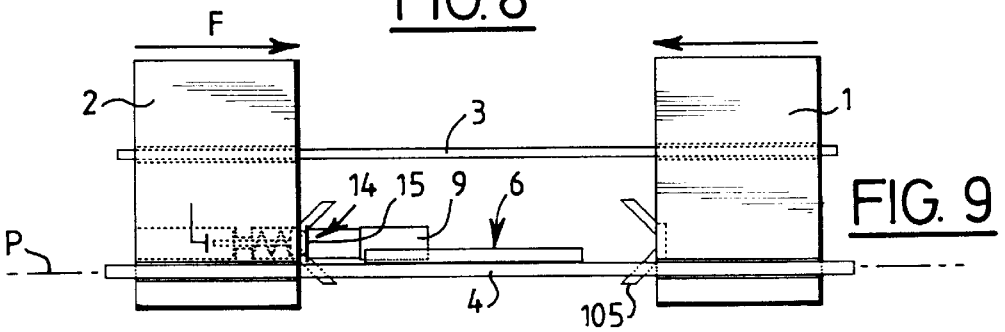
Figure 10:
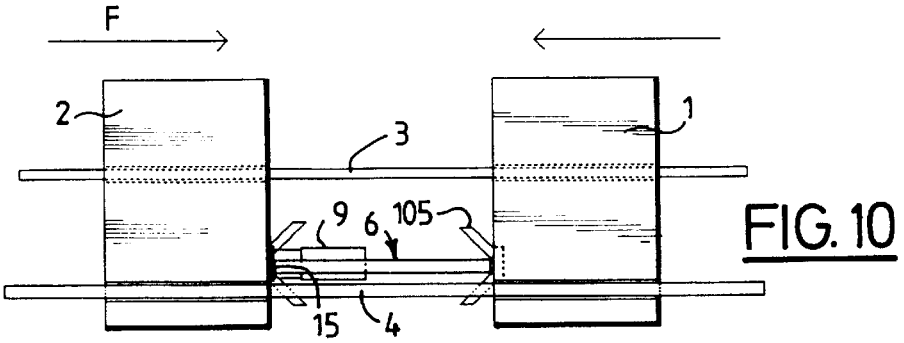
FIG. 10 is similar to FIG. 9 but shows the jaws in the final position.

The variation illustrated in FIGS. 8 to 10 (in which the electric parts have been omitted) differs from the preceding embodiment only by the replacement of the clamps 5 by four V-shaped members 105 which are arranged in the same manner in a facing relation to one another in pairs. Two V-shaped members are fixed to the jaw 1 and the other two are fixed to the jaw 2.

The position sensors 14 are disposed at the inner ends of the V-shaped members. The position members 14 are so arranged that contacts between pin 16 and electric switch 18 are established when the plates 15 reach these inner ends.

It will be understood that the two jaws will cease to move toward each other in this case when the rims 7 of the frame, after having been slightly raised by the V-shaped members, are just in contact with the inner ends of the two lower V-shaped members (FIG. 10).

As a variation, the displacement of the jaws may be controlled manually, for example by a screw-and-nut system as described in the aforementioned document FR-A-2 720 524. The sensors 14 then deliver an optical and/or sound warning signal which informs the operator of the correct relative position of the two jaws.

What is claimed is:

1. A spectacles frame holder comprising:

a first jaw;

a second jaw, wherein at least one of said first and second jaws is slidably mounted so that said first and second jaws are capable of relative movement toward and away from each other;

means for holding a spectacles frame between said jaws in a reference plane; and at least one sensor provided on at least one of said first and second jaws, said sensor comprising means adapted to cooperate with the spectacles frame for providing a position indicating signal upon arrival of said jaws in a predetermined position relative to the spectacles frame in the course of the relative movement of said two jaws toward each other.

2. A spectacles frame holder as claimed in claim 1, wherein one of said first and second jaws is an upper jaw and the other of said first and second jaws is a lower jaw, and said at least one position sensor is provided on said lower jaw in a facing relation to at least one rim of the spectacles frame.

3. A spectacles frame holder as claimed in claim 2, further comprising:

a nose member carried by and projecting from said lower jaw in a direction toward said upper jaw; and a first spring for biasing said nose member in the direction toward said upper jaw, wherein said nose member is disposed so as to engage and hold the frame against said upper jaw.

4. A spectacles frame holder as claimed in claim 3, further comprising a second spring for biasing said at least one sensor in a direction toward said upper jaw, wherein said second spring is weaker than said first spring.

5. A spectacles frame holder as claimed in claim 1, wherein said holding means comprises a plurality of frame clamps movable in a direction which is perpendicular to the reference plane, wherein said at least one sensor is adapted to emit a signal when said at least one jaw is in an immediate vicinity of the frame.

6. A spectacles frame holder as claimed in claim 1, wherein said holding means comprises a plurality of V-shaped centering elements connected to said first and second jaws, and said at least one sensor is adapted to emit a signal when the frame contacts an interior end surface of at least one of said V-shaped centering elements.

7. A spectacles frame holder as claimed in claim 1, further comprising a plurality of retractable support rods for supporting rims of the frame, wherein said at least one sensor is disposed on said at least one jaw in the vicinity of at least one of said support rods.

8. A spectacles frame holder as claimed in claim 1, further comprising:

a motor for effecting said relative movement between said first and second jaws;

a switch disposed adjacent to said at least one sensor; and a control unit operably connected to said switch, wherein said at least one sensor is capable of operating said switch to cause said control unit to control operation of said motor.

9. A spectacles frame holder as claimed in claim 8, wherein said control unit is adapted to control said motor for stopping said relative movement of said first and second jaws upon receiving the signal emitted by said at least one sensor.

10. A spectacles frame holder as claimed in claim 8, wherein said control unit is adapted to control said motor in order to reverse said relative movement of said first and second jaws in response to a signal emitted from said at least one sensor, and to stop the reverse movement of said first and second jaws when the signal emitted from said at least one sensor ceases.

11. A spectacles frame holder as claimed in claim 1, wherein said at least one sensor is disposed so as to contact the frame upon arrival of said jaws in the predetermined position.

12. A holder for spectacles frame having two rims interconnected by a bridge, said holder comprising:

a pair of guide rods;

first and second jaw members supported on said guide rods such that said jaw members are movable toward and away from each other;

a frame support structure for supporting the frame relative to said first and second jaw members;

a nose member resiliently supported on said first jaw member and extending in a direction toward said second jaw member; and a first sensor disposed on said first jaw member for sensing a position of the frame relative to said first and second jaw members.

13. A holder as claimed in claim 11, further comprising:

a first frame clamp mounted on said first jaw member, said first clamp including a pair of clamp members for engaging opposite sides of the frame; and a second frame clamp mounted on said first jaw member, said second frame clamp including a pair of clamp members for engaging opposite sides of the frame.

14. A holder as claimed in claim 12, wherein said support structure comprises:

a first support rod, extending between said first and second jaw members, for supporting one of the frame rims;

a second support rod, extending between said first and second jaw members, for supporting the other of the frame rims.

15. A holder as claimed in claim 14, further comprising a second sensor disposed adjacent said second support rod sensing a position of the frame relative to said first and second jaw members, wherein said first position sensor is disposed adjacent said first support rod.

* * * * *